US008894516B2

(12) United States Patent
Tillery

(10) Patent No.: US 8,894,516 B2
(45) Date of Patent: Nov. 25, 2014

(54) TABLE TENNIS PADDLE

(71) Applicant: Glenn W. Tillery, Hampton Cove, AL (US)

(72) Inventor: Glenn W. Tillery, Hampton Cove, AL (US)

( * ) Notice: Subject to any disclaimer, the term of this patent is extended or adjusted under 35 U.S.C. 154(b) by 0 days.

(21) Appl. No.: 13/757,356

(22) Filed: Feb. 1, 2013

(65) Prior Publication Data

US 2014/0221133 A1 Aug. 7, 2014

(51) Int. Cl.
*A63B 59/04* (2006.01)
*A63B 49/08* (2006.01)

(52) U.S. Cl.
CPC ..... *A63B 59/04* (2013.01); *A63B 49/08* (2013.01)
USPC ..... 473/527; 473/528

(58) Field of Classification Search
CPC ..... A63B 59/04; A63B 59/0014
USPC ..... 473/524, 526, 527, 549, 551, 552, 528, 473/529
See application file for complete search history.

(56) References Cited

U.S. PATENT DOCUMENTS

| | | | | | |
|---|---|---|---|---|---|
| D164,883 | S | * | 10/1951 | Schmid | D21/731 |
| D168,192 | S | * | 11/1952 | Schmid | D21/731 |
| 3,674,268 | A | * | 7/1972 | Shellman, Sr. | 473/526 |
| 6,969,329 | B2 | * | 11/2005 | Popovich | 473/527 |

* cited by examiner

*Primary Examiner* — Nini Legesse
(74) *Attorney, Agent, or Firm* — George P. Kobler; Lanier Ford Shaver & Payne P.C.

(57) ABSTRACT

A table tennis paddle is disclosed designed to enhance player control using a penhold grip. The paddle includes a thumb tab extending from the handle on which a player rests a thumb and, in an embodiment, a finger tab extending from the opposite side of the handle. The finger tab preferably defines a recess adjacent the handle which receives the forefinger.

11 Claims, 3 Drawing Sheets

TABLE TENNIS PADDLE

BACKGROUND

1. Field

The present invention relates generally to table tennis paddles, and, in particular, to table tennis paddles for use with a penhold grip.

2. Description of the Problem and Related Art

Design for conventional table tennis paddles has advanced very little. Essentially, the paddle is a diminished tennis racquet comprising a handle and a blade. Likewise, many players employ the same "handshake" grip that is used with a tennis racquet with the handle resting the palm of the hand and the blade extending from the thumbward side of the hand. Some playersemploy a penhold grip where the handle is held between the thumb and forefinger and supported by the "V" formed therebetween, and the blade of the paddle extends from between the tips of the fingers, in the way a pen point is held. See, e.g., FIGS. 6 & 7.

Not a recent innovation, the penhold grip requires a great amount of skill to play effectively, however, because it requires great control to exert spin on a table tennis ball. The traditional penhold grip employs only one side of the blade for both forehand and backhand shots; however, over the last decade highly skilled penhold style players have begun using the opposite blade surface to strike the ball in what is referred to as a "reverse penhold backhand" which requires even greater control than the traditional penhold style. Provided herein is a design for a table tennis paddle which enables greater control when using a either a traditional or penhold or a reverse penhold backhand grip.

SUMMARY

For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein.

A table tennis paddle is disclosed herein that is designed to enhance player control using a penhold grip, and particularly the reverse penhold backhand. The paddle includes a thumb tab extending from the handle on which a player rests a thumb and, in an embodiment, a finger tab extending from the opposite side of the handle. The finger tab preferably defines a recess adjacent the handle which receives the forefinger.

These and other embodiments of the present invention will also become readily apparent to those skilled in the art from the following detailed description of the embodiments having reference to the attached figures, the invention not being limited to any particular embodiment(s) disclosed.

BRIEF DESCRIPTION OF THE DRAWINGS

The present invention is described with reference to the accompanying drawings. In the drawings, like reference numbers indicate identical or functionally similar elements.

DETAILED DESCRIPTION

The various embodiments of the present invention and their advantages are best understood by referring to FIGS. 1 through 9 of the drawings. The elements of the drawings are not necessarily to scale, emphasis instead being placed upon clearly illustrating the principles of the invention. Throughout the drawings, like numerals are used for like and corresponding parts of the various drawings.

Furthermore, reference in the specification to "an embodiment," "one embodiment," "various embodiments," or any variant thereof means that a particular feature or aspect of the invention described in conjunction with the particular embodiment is included in at least one embodiment of the present invention. Thus, the appearance of the phrases "in one embodiment," "in another embodiment," or variations thereof in various places throughout the specification are not necessarily all referring to its respective embodiment.

This invention may be provided in other specific forms and embodiments without departing from the essential characteristics as described herein. The embodiments described above are to be considered in all aspects as illustrative only and not restrictive in any manner. The following claims rather than the foregoing description indicate the scope of the invention.

Figure 1:
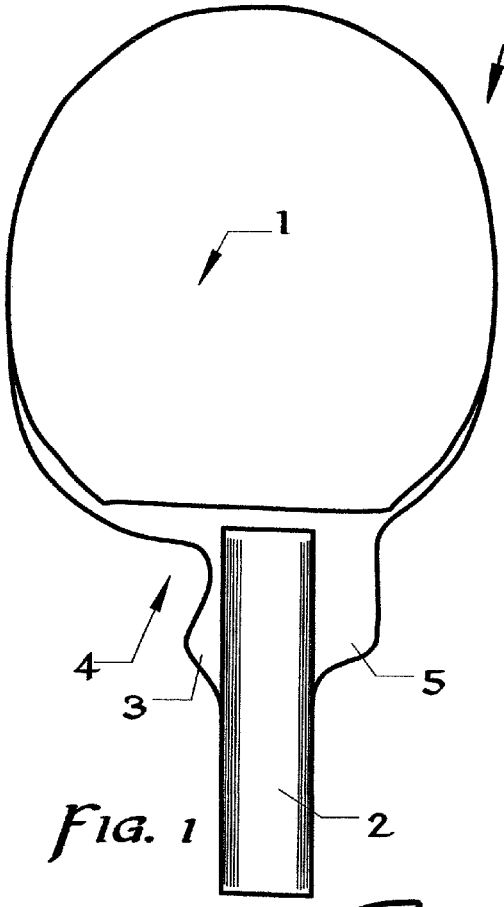
FIG. 1 illustrates an exemplary embodiment of the disclosed table tennis paddle.

FIG. 1 depicts an exemplary embodiment the inventive table tennis paddle 10 with a conventional paddle blade and handle. This embodiment includes a thumb tab 5 extending laterally from the handle 2 and a peaked finger tab 3 extending laterally from the opposite side of the handle in such a way as to define an arcuate recess 4 between the finger tab 3 and the bottom edge of the blade 1. Both tabs 3, 5 define planes that are parallel with the plane defined by the blade 1. Preferably, the thumb tab 5 and the recess 4 are located adjacent to the edge of the blade 1.

Figure 6:
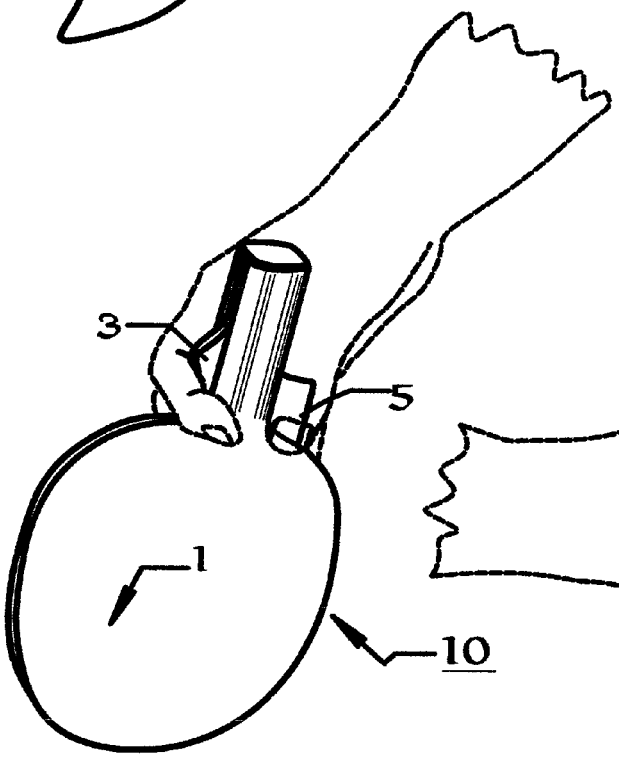
FIGS. 6 & 7 depict a player's hand (in dashed lines) holding the exemplary paddle in a penhold grip with the thumb on the thumb tab and the forefinger received within a recess defined by the finger tab.
Figure 7:
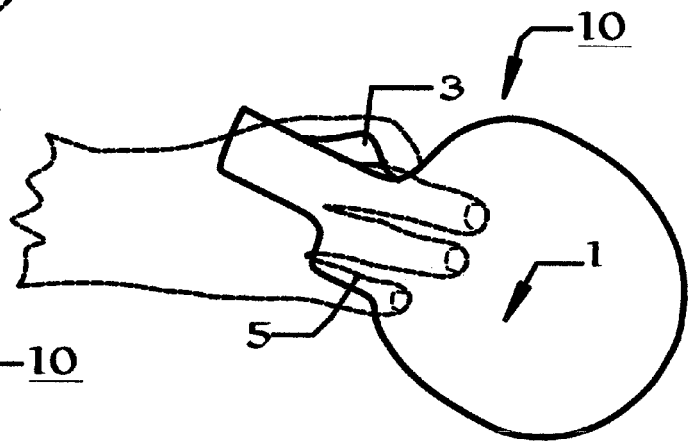

Referring to FIGS. 6 and 7, the exemplary paddle 10 is held in the penhold grip with the thumb resting against the thumb tab 5 and the forefinger received in the recess 4 defined by the finger tab 3 with the forefinger in contact with the tab 3. It will be appreciated that the thumb tab 5 and the finger tab 3 allow the player to exert greater rotational control. The tabs 3, and 5 essentially provide a lever to increase the rotational moment about the handle's longitudinal axis, whereby pressure from the thumb on the thumb tab 5, or from the forefinger on the finger tab 3 creates faster rotation. Rotation is also more easily stopped or damped through the same forces exerted by the thumb and finger as required. The improved rotational control permits greater accuracy of the angle of the blade surface with respect to the ball.

This configuration provides another advantageous by increasing the striking surface of the blade when using a penhold grip. Players using a penhold grip with a conventional paddle attempt to achieve greater rotational control by placing the thumb and forefinger on the part of the blade 1 surface near where it meets the handle. This has the disadvantage of allowing the remaining fingers to extending far into the center of the blade surface, reducing the area available to contact the ball, requiring greater mastery of the paddle to effectively use the penhold grip. Accordingly, the design of this inventive paddle permits a penhold grip further away from the blade 1 surface to provide more area for the player's fingers to rest and more striking area in the blade 1.

Figure 2:
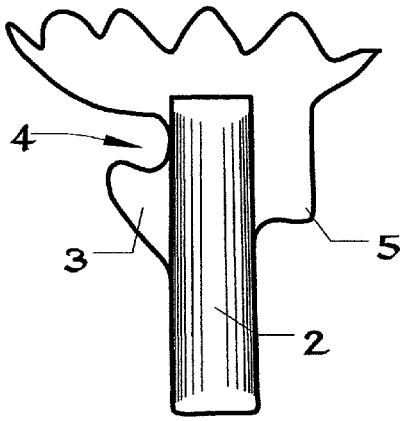
FIG. 2 illustrates a second exemplary embodiment of the table tennis paddle depicted in FIG. 1.
Figure 3:
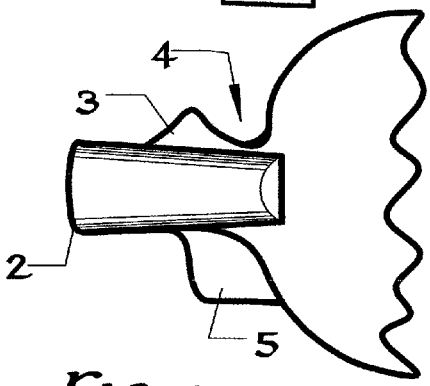
FIG. 3 illustrates a third exemplary embodiment of the table tennis paddle depicted in FIG. 1.
Figure 4:
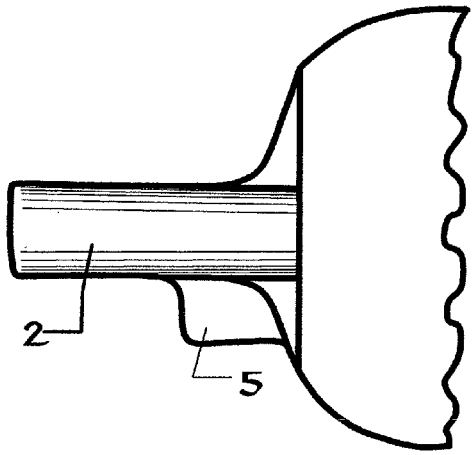
FIG. 4 illustrates a fourth exemplary embodiment of the table tennis paddle depicted in FIG. 1.
Figure 5:
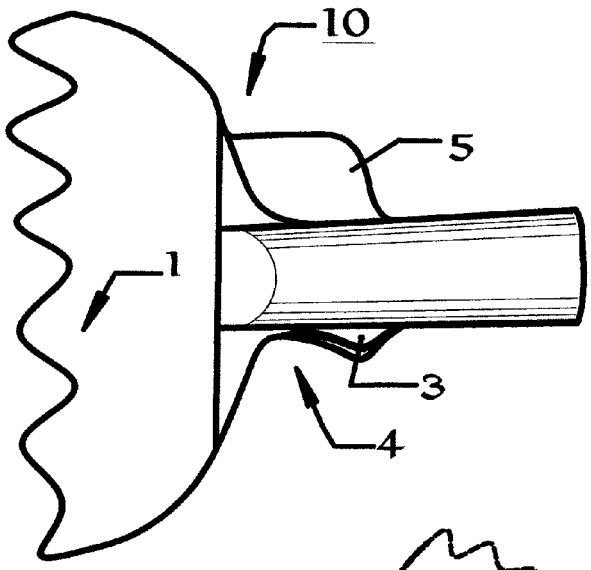
FIG. 5 illustrates a fifth exemplary embodiment of the table tennis paddle depicted in FIG. 1.

FIGS. 2 through 5 show various other embodiments of tab shapes that have also been found to be advantageous. For example, the finger tab 3 of FIG. 2, is provided in a more of an arcuate or "hooked" shape and correspondingly defines a more pronounced recess 4 for greater control, benefitting players that may be new to penhold grip use. FIG. 3 illustrates a finger tab 3 with a more defined peak, while FIG. 5 depicts a finger tab 3 with a more diminished peak. Finally, FIG. 4 illustrates a paddle without a finger tab for more experienced players.

Figure 8:
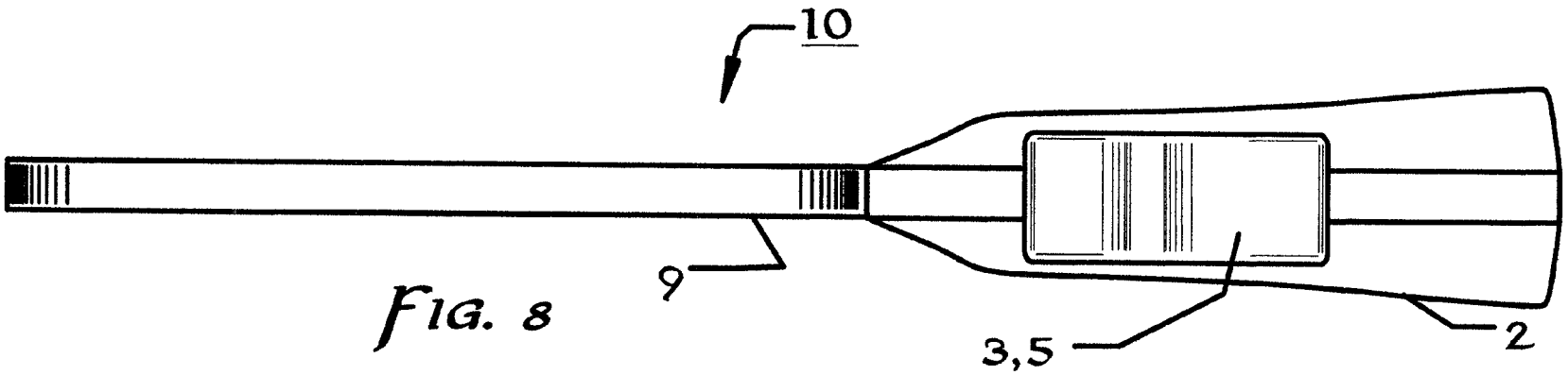
FIG. 8 is a view of a paddle edge showing another exemplary embodiment of a table tennis paddle.
Figure 9:
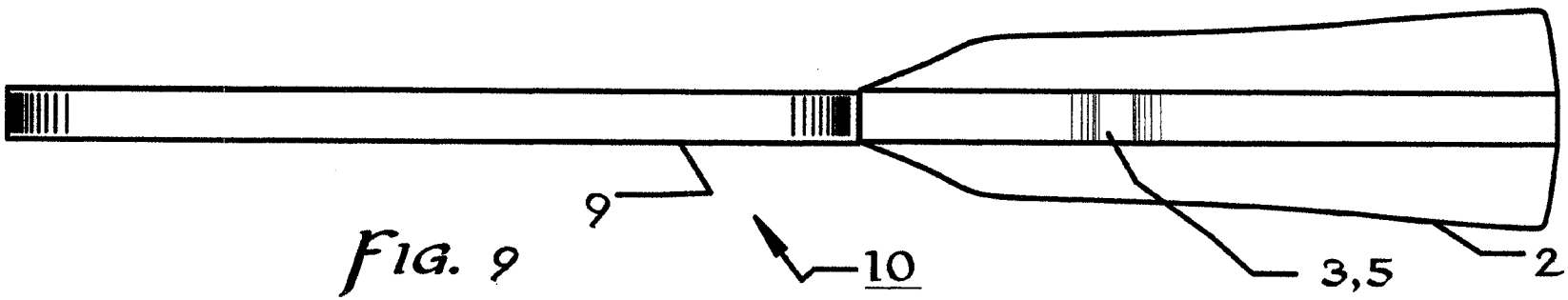
FIG. 9 is a second view of another paddle edge showing yet another exemplary embodiment of a table tennis paddle.

FIGS. 8 and 9 simply illustrate different possible thicknesses of tabs 3, 5 that may be used. Although the tab shown appears to be shaped like the finger tab 3 discussed above, it will be appreciated that the following discussion is intended to also apply to the above-described thumb tab 5, as well. Those familiar with table tennis paddle 10 construction will recognize that a paddle 10 typically comprises a unitary substrate 9 in the shape of the blade 1 and the handle 2. The substrate 9 may also comprise a laminate. The inventive paddle 10 disclosed herein may be formed with the tabs 3, 5 incorporated into the substrate 9 shape, as shown in FIG. 9, and having the same thickness as the substrate 9. Alternatively, yet without limitation, the tabs may be of an increased thickness and perhaps affixed to the handle 2 as a separate piece.

As described above and shown in the associated drawings, the present invention comprises an inventive table tennis paddle. While particular embodiments of the invention have been described, it will be understood, however, that the invention is not limited thereto, since modifications may be made by those skilled in the art, particularly in light of the foregoing teachings. It is, therefore, contemplated by the appended claims to cover any such modifications that incorporate those features or those improvements that embody the spirit and scope of the present invention.

What is claimed is:

1. A table tennis paddle having a blade defining a planar surface and a handle extending from the blade, said paddle comprising:

a thumb tab extending laterally from the handle adjacent an edge of the blade and defining a plane parallel to the blade surface; and a finger tab extending laterally from an opposite side of the handle with respect to the thumb tab and defining a plane parallel to the blade surface and defining an arcuate recess between the finger tab and an edge of the blade adjacent the handle.

2. The table tennis paddle of claim 1, wherein said finger tab comprises an arcuate shape.

3. The table tennis paddle of claim 1, wherein said finger tab comprises a peaked shape.

4. The table tennis paddle of claim 1, wherein said thumb tab is integrally formed with the handle.

5. A table tennis paddle for use with a penhold grip comprising:

a handle from which extends a blade defining a planar striking surface;

a first tab extending laterally from said handle and adjacent said blade, and defining a surface that is parallel with said striking surface; and a second tab extending from said handle, divergingly with respect to said first tab and defining a surface parallel with said striking surface, said second tab defining an arcuate recess between said handle and said blade.

6. The table tennis paddle of claim 5, wherein said second tab comprises one of an arcuate shape and a peaked shape.

7. The table tennis paddle of claim 5, wherein said recess is defined between said second tab and said blade such that it abuts an edge of said blade.

8. The table tennis paddle of claim 7, wherein said second tab comprises one of an arcuate shape and a peaked shape.

9. The table tennis paddle of claim 5, wherein said first and second tabs are formed integrally with said handle.

10. The table tennis paddle of claim 9, wherein said recess is defined between said second tab and said blade such that it abuts an edge of said blade.

11. The table tennis paddle of claim 10, wherein said second tab comprises one of an arcuate shape and a peaked shape.

* * * * *